US006016031A

United States Patent [19]

Lapatovich et al.

[11] Patent Number: 6,016,031

[45] Date of Patent: Jan. 18, 2000

[54] HIGH LUMINANCE ELECTRODELESS PROJECTION LAMP

[75] Inventors: Walter P. Lapatovich, Boxford; Gerhard W. Doell, Beverly; Robert K. Smith, Wilmington, all of Mass.

[73] Assignee: Osram Sylvania Inc., Danvers, Mass.

[21] Appl. No.: 08/909,323

[22] Filed: Aug. 11, 1997

[51] Int. Cl.[7] ..... H01J 1/62; H01J 63/04; H01J 17/16; H01J 61/30

[52] U.S. Cl. ..... 313/493; 313/634; 313/637; 313/638; 313/35; 315/248; 315/344; 220/2.1 R

[58] Field of Search ..... 313/35, 46, 491, 313/493, 573, 634–37, 638–43; 220/2.1 R; 315/248, 344

[56] References Cited

U.S. PATENT DOCUMENTS

| | | | |
|---|---|---|---|
| 3,689,793 | 9/1972 | Walz | 313/634 |
| 4,340,264 | 7/1982 | Hottes | 313/634 X |
| 4,503,356 | 3/1985 | Kobayashi et al. | 313/634 |
| 4,532,427 | 7/1985 | Matthews et al. | 250/492 |
| 4,695,757 | 9/1987 | Ury et al. | 313/44 |
| 4,825,125 | 4/1989 | Lagushenko et al. | 313/634 X |
| 4,894,592 | 1/1990 | Ervin et al. | 315/248 |
| 5,021,704 | 6/1991 | Walker et al. | 313/35 |
| 5,216,322 | 6/1993 | Fuchs | 313/490 X |
| 5,252,886 | 10/1993 | Renardus et al. | 313/634 X |
| 5,404,076 | 4/1995 | Dolan et al. | 313/572 |

*Primary Examiner*—Nimeshkumar D. Patel
*Assistant Examiner*—Mack Haynes
*Attorney, Agent, or Firm*—William H. McNeill

[57] ABSTRACT

An Electrodeless High Intensity Discharge (EHID) lamp for projection applications. The lamp has a small (nominal dimensions: 2 mm I.D., 3 mm O.D., 6 mm internal length) capsule, which is constricted in a mid-portion thereof. The constriction squeezes the plasma within the capsule and provides a higher power density. This in turn produces a higher luminance in the center of the arc. This focal point of the projection system is constant over the life of the lamp, owing to the fact that the system is electrodeless. The arc tube or capsule is thickened in the vicinity of the constriction to permit heat transfer through the vitreous silica (commonly called quartz). The thickening carries the heat away from the now hotter mid-portion area. This thickening cools by virtue of increasing the thermal conduction through the glass.

25 Claims, 3 Drawing Sheets

HIGH LUMINANCE ELECTRODELESS PROJECTION LAMP

FIELD OF THE INVENTION

The invention pertains to projection lamps and, more particularly, to a projection lamp comprising an electrodeless, high intensity discharge (EHID) lamp having a high luminance and good color.

BACKGROUND OF THE INVENTION

Modern projection systems display video and digital information for business, commercial, technical and residential use. One form of display system can be a plasma display, which generates its own light.

Projection systems require a light source that is both compact and high in brightness. Many projection systems require a separate source of bright light, and frequently employ high intensity discharge (HID) lamps, many of which use electrodes and metal salt additives to improve their light quality. Electroded HID lamps suffer from a problem known as "meltback", and deteriorate over time.

The throughput or screen illuminance of an optical system is highly dependent on the compactness of the light source, its luminance (lumens per steradian-mm$^2$ or candela/mm$^2$), or brilliance.

As aforementioned, a number of HID lamps having electrodes are currently used in projection display systems. A drawback of these electrode HID lamps is that they are prone to electrode meltback due to the high power and aggressive chemistry used to generate appropriate colors. The advantage of these lamps, however, is high lumen output, high luminance, good color, and small arc gap. A small arc gap is essential for coupling the light through the optical system. Luminances in these lamps approach 500 cd/mm$^2$.

Examples of electrode HID lamps are the OSRAM Model No. HTI 150 W. and the Model No. HTI 250 W/22,32, manufactured by the assignee. The highest luminance point of these HID lamps is at their ends in front of the electrodes. Consequently, there are two hot spots. The projection or optical system can accommodate only one luminance point, and therefore a portion of the light must be discarded. As the electrodes melt, or burn back, the hot spot is moved from the optical focus, thus causing throughput deterioration.

The present invention is a new electrodeless high intensity discharge (EHID) lamp for photo optical applications. The new EHID lamp has a unique construction that provides high luminance.

The current invention reflects the discovery that constricting the mid-portion of the lamp capsule will yield a higher luminance output.

The invention also features an improved cooling arrangement for the lamp capsule, which provides longer operative life.

The present invention has its highest luminance point away from the ends of the capsule (i.e., in the center of the tube). This center luminance stays in the same place over time.

DISCUSSION OF RELATED ART

Others have attempted to use electrodeless HID lamps in optical systems using a sulfur-based chemical fill. Such a lamp is more fully described in U.S. Pat. No. 5,404,076, issued to Dolan et. al. This lamp produces a full spectrum in visible light, but suffers from low luminance (about 19 cd/mm$^2$), which is only slightly better than a tungsten halogen lamp.

A second disadvantage of this lamp is that it is primarily a surface emitter and does not couple well to the optical system. The surface emitter of this lamp is a large (5 mm diameter) ball of light at the focus of the optic. The lamp is cooled with jets of air because of the high loading, as taught in U.S. Pat. No. 4,532,427, issued to Matthews et. al.; U.S. Pat. No. 4,695,757, issued to Ury et. al.; U.S. Pat. No. 5,021,704, issued to Walker et. al.; and U.S. Pat. No. 4,894,592, issued to Ervin et. al.

The lamp must be rotated to provide a uniform discharge and uniform cooling. The rotation is undesirable, however, since it contributes to wiggle in the optics and audible noise. Audible noise is an important concern, of course, since it interferes with the audio system of video projection systems.

In the aforementioned U.S. Pat. No. 4,504,768, a shaped arc tube is shown for locally heating the arc tube to prevent fill condensation. A feature of the present invention uses a constricted central area for cooling. Thus, this feature is for a diametrically opposite purpose.

Another type of projection lamp is the Philips ultra high pressure mercury lamp. This lamp has a luminance of about 500 cd/mm and is not as prone to electrode meltback because it lacks the aggressive chemistry of the metal halide lamps. This lamp is described in an article by E. Schnedler and H. Wijngaarde, entitled, "Ultrahigh-intensity Short Arc Long Life Lamp System", Invited Paper 11.1, Soc. for Information Display, Vol. XXVI, Orlando, Fla. 1995, pp. 131–134.

However, this lamp has a relatively low general color rendering index and lacks the red content of metal halide lamps. It simply does not provide true red colors.

Other HID lamps that contain only inert gas, such as xenon, are also employed in video projectors. These lamps have the advantage of essentially no chemical interaction between the electrode and fill (xenon). However, they suffer from high waste heat, due to the intrinsic low efficacy of the xenon in converting electrical power into usable light. Another problem affecting these lamps is the turbulence caused by density changes in the index of refraction, as the light from the arc passes through the high density xenon gas. This turbulence causes flicker.

DISCLOSURE OF THE INVENTION

In accordance with the present invention, there is provided an Electrodeless High Intensity Discharge Lamp (EHID) for projection applications. The lamp comprises a small (nominal dimensions: 2 mm I.D., 3 mm O.D., 6 mm internal length) capsule, which is constricted at a mid-portion thereof. The constriction squeezes the plasma within the capsule and provides a higher power density. This in turn produces a higher luminance in the center of the arc. This focal point of the projection system is constant over the life of the lamp, owing to the fact that the system is electrodeless. The arc tube or capsule is thickened in the vicinity of the constriction to permit heat transfer through vitreous silica (commonly called quartz). The thickening carries the heat away from the now hotter mid-portion area. This thickening cools by virtue of increasing the thermal conduction through the glass.

To achieve high luminance, the lamp is provided with a high power density. EHID lamps have been run in the range of 1,000 to 9,000 W/cm$^3$. Typically, lamps of the size of the capsule mentioned above run at power densities of about 3,000 W/cm$^3$. At the highest power density, these lamps must be cooled to prolong life; otherwise, the surface temperature would exceed the melting temperature of the lamp envelope. This would typically occur at power densities of about 4,000 W/cm$^3$. The required high luminance is achieved by running the lamps at the higher density (about 9,000 W/cm$^3$). Cooling is provided by a fan or a source of compressed air and a nozzle arrangement. Lamp life is adequate if the surface temperature is maintained below 1000° C., and preferably below 900° C.

In one embodiment of this invention, a single nozzle is directed towards the top of a horizontally burning lamp. This causes the arc to bend less, due to cooling of the outer and inner wall. The gas density redistributes itself, reducing the buoyant force on the arc.

In another embodiment of the invention, the capsule of the lamp is cooled by a series of jets disposed about the lateral periphery of the lamp envelope.

It is an object of the instant invention to provide a high color rendering light source of high luminance, small size, and which is resistant to burn-back phenomena.

It is another object of this invention to provide an improved EHID lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Generally speaking, the invention features an electrodeless high intensity discharge lamp of improved luminance. In one embodiment, the lamp has a constricted capsule about a mid-portion thereof. In another embodiment, the capsule is thickened about a mid-portion to provide increased heat conduction and, hence, cooling of the lamp capsule.

Figure 1:
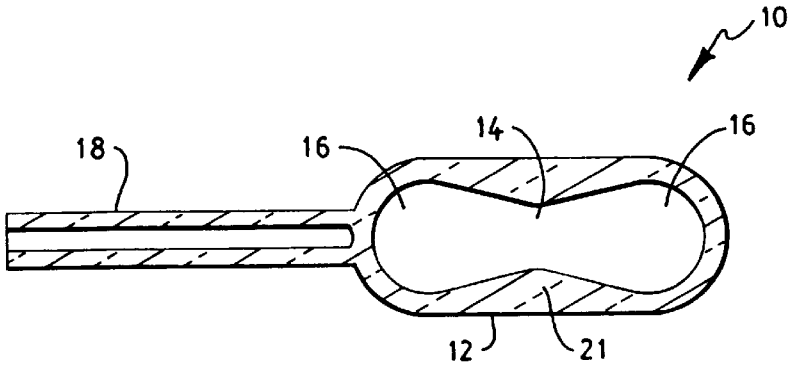
FIG. 1 illustrates a schematic view of a constricted EHID lamp in accordance with the present invention.

Now referring to FIG. 1, a lamp 10 is shown having a light transmissive capsule 12 with constricted region 14 about its mid-portion. The ends 16 of the capsule chamber are expanded. The capsule has nominal dimensions: 2 mm I.D., 3 mm O.D., and 6 mm internal length. The center constriction region has a nominal diameter of about 1 mm. The capsule 12 is carried by a support stem 18. The constricted region 14 has a thickened wall 21, as shown. The thickened wall 21 allows for increased heat conductance to permit heat transfer through the vitreous silica (commonly called quartz) of lamp 10.

Figure 2:
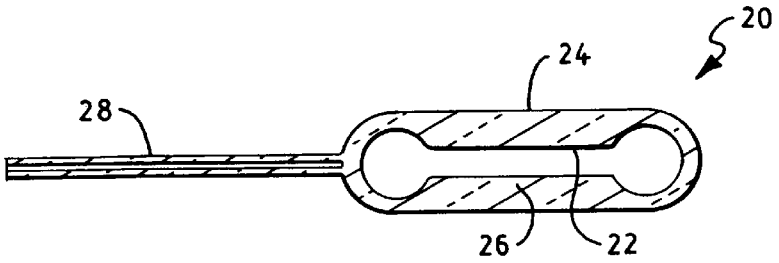
FIG. 2 shows a schematic view of an alternate embodiment of the EHID lamp illustrated in FIG. 1.

Referring to FIG. 2, a small lamp 20, which is an alternate embodiment of lamp 10 (FIG. 1), is shown having a constricted center channel 22 for the lamp envelope 24. The constricted channel 22 has a thickened wall 26, similar to wall 21 of FIG. 1. The thickened wall 26 allows for increased heat conductance to permit heat transfer through the vitreous silica of lamp 20. The envelope 24 is carried by support stem 28.

To achieve high luminance, the lamp 10 is provided with a high power density. EHID lamps have been run in the range of 1,000 to 9,000 W/cm$^3$. Typically, lamps of the size of capsule mentioned above run at power densities of about 3,000 W/m$^3$. At the highest power density, these lamps must be cooled to prolong life; otherwise, the surface temperature would exceed the melting temperature of the lamp envelope. This would typically occur at power densities of about 4,000 W/cm$^3$. The high luminance needed is achieved by running the lamps at the higher density of about 9,00 W/m$^3$.Cooling is provided by a fan or a source of compressed air and a nozzle arrangement. Lamp life is adequate if the surface temperature is maintained below 1000° C. and preferably below 900° C.

Figure 2A:
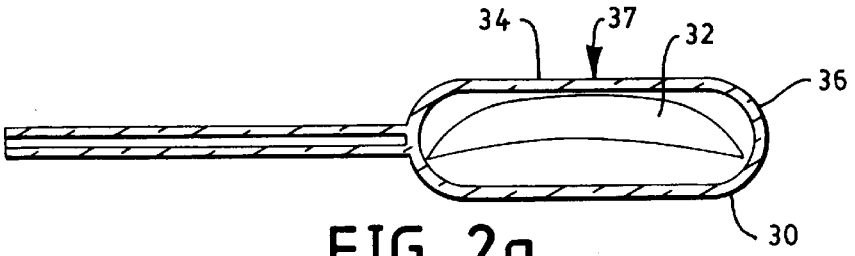
FIG. 2a PRIOR ART
FIG. 2*a* depicts a schematic view of an overpowered lamp having a hot spot.

Referring to FIG. 2*a*, a lamp 30 is shown with a bowed arc 32 and a hot spot 34 in the capsule wall 36, that results from the contact of bowed are 32 therewith. Hot spots can develop in the normal operation of a lamp 30 if cooling is uneven, or if there are momentary instabilities during start-up.

Figure 2B:
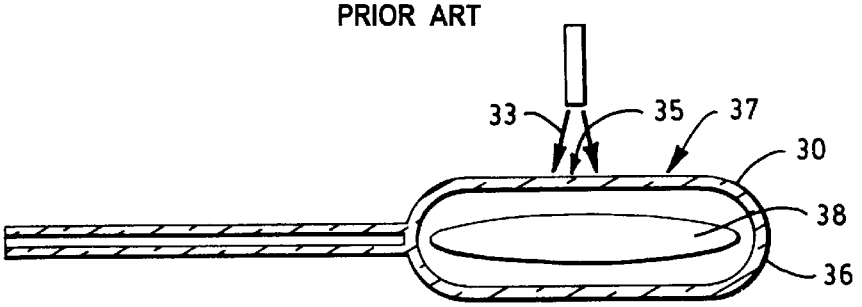
FIG. 2*b* depicts a schematic view of the overpowered lamp of FIG. 2*a*, whose arc has been straightened by a cooling jet, in accordance with this invention.

Referring to FIG. 2*b*, the lamp 30 is shown being cooled at a mid-portion 35 of the envelope 37, by an air flow nozzle or cooling jet 33. It will be observed that the bowed arc 32 has now become a straightened arc 38. The cooling jet 40 forces the arc 32 away from the wall 36, and so reduces the thermal transport to the wall from the contiguous arc. Hence, a lower flow of air is required than would be expected.

Figure 3:
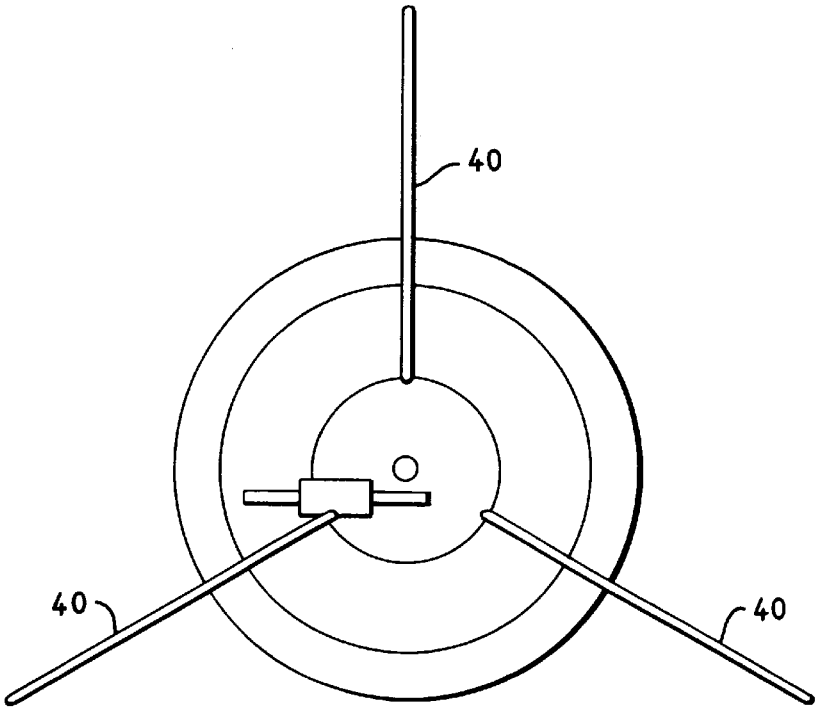
FIG. 3 shows a schematic view of a cooling embodiment of this invention, wherein three cooling nozzles are mounted at equally distanced angles of 120° about a reflector and oriented so the air jets impinge on the lateral surfaces of the approximately cylindrical arc tube.
Figure 4B:
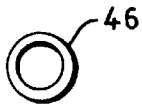
FIG. 4b PRIOR ART
FIG. 4*b* illustrates a schematic sectional front view of the conical air flow nozzle shown in FIG. 4*a;*
Figure 4D:
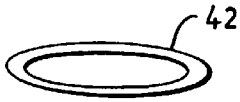
FIG. 4*d* illustrates a schematic sectional front view of the fan-shaped air flow nozzle shown in FIG. 4*c;*
Figure 4A:
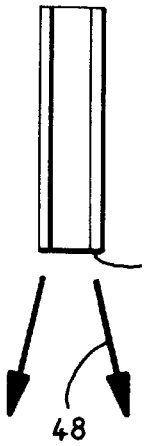
FIG. 4a PRIOR ART
FIG. 4*a* illustrates a schematic sectional side view of a typical conical air flow nozzle.
Figure 4C:
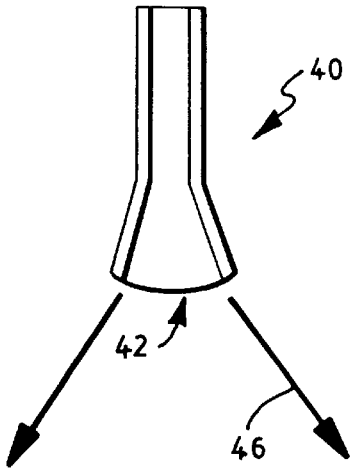
FIG. 4*c* illustrates a schematic sectional side view of a fan-shaped air flow nozzle according to the invention.

In cooling an overpowered lamp 30 with only one nozzle, the air jet is directed on the top of the horizontally burning arc 32. In a preferred embodiment, multiple nozzles 40 are disposed about the lateral circumference of the lamp 30 at approximately equal angles, as shown in FIG. 3. The nozzles 40 provide uniform cooling and prevent transient, hot spot development. The nozzle ends 42 are shaped into ovals as shown in FIGS. 4*c* and 4*d*. The end shaping is needed to spread the air into a fan 44 that cools the entire length of the capsule or envelope of the lamp. The fan 44 of air is directed onto the lamp so that the elongated part of the fan is parallel to the long axis of the lamp. This ensures uniform cooling along the lamp length. This is an improvement over prior art, which uses circular nozzles 46, as shown in FIGS. 4*a* and 4*b*. The circular nozzles 46 produce conical air flows 48.

The spreadout flow of the fan eliminates the prior art need to continuously rotate the capsule to achieve uniform cooling.

The oval end 42 of the nozzle 40 also has a radius, so as to avoid turbulence near sharp corners. The fluid flow pattern from such nozzles is planar, as compared to the circular nozzle. When placed near the lamp, the distance to the nozzle can be adjusted to provide planar flow which completely engages the small EHID lamp capsule.

In the current embodiment, a stagnation pressure of 20 psi with flow limiter set to 10 liters per minute (1/min) is used with a stainless steel tube of 0.052" inner diameter, and 0.065" outer diameter. The oval orifice is about 0.016" by 0.075". It is important that the orifice be free of any burrs which would disrupt the fluid flow. The nozzles 40 are polished with grit silicon carbide paper to achieve a smooth finish. The ends are rounded with a radius of curvature of about 0.040". Additionally, the tubing can be of steel, nickel and almost any metal. Also, ceramic and glass work equally well. The glass nozzles can be formed from vitreous silica, and the ceramic nozzles can be machined or pressed green and then fired into shape, as with polycrystalline alumina. The elongated flow is directed to be parallel to the long axis of the lamp, ensuring uniform cooling. Sufficient spread in the orthogonal direction, and the use of three nozzles (as shown in FIG. 3, for example) ensure uniform cooling in the azimuthal direction as well.

Figure 5:
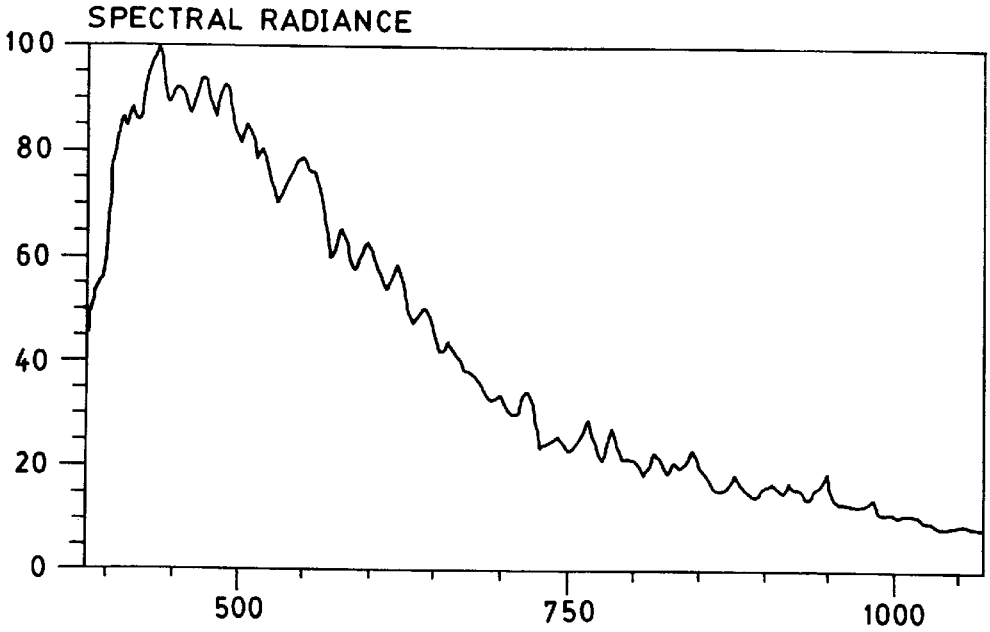
FIG. 5 depicts a spectrum diagram of an EHID lamp in accordance with this invention.

A spectrum of such lamps filled with a chemistry taught and disclosed in a copending application, Ser. No. (Docket No. 96-1-252), is shown in FIG. 5. The teachings of the copending application are meant to be incorporated herein by way of reference. An example of an appropriate chemistry can be a fill consisting of aluminum triiodide, indium iodide, and thorium tetraiodide with mercury and an inert gas selected from a group of inert gases such as argon, krypton, xenon, and mixtures thereof. This chemistry can be modified so as to replace the typical thorium tetraiodide with such materials as hafnium or zirconium iodide, as taught in the aforementioned copending application. The contribution to the spectrum from the hafnium or zirconium is similar to the thorium in producing multiple spectral lines throughout the visible range. Thorium is the preferred additive and the luminance observed at approximately 100 W of microwave power is 325 cd/mm$^2$.

Figure 6:
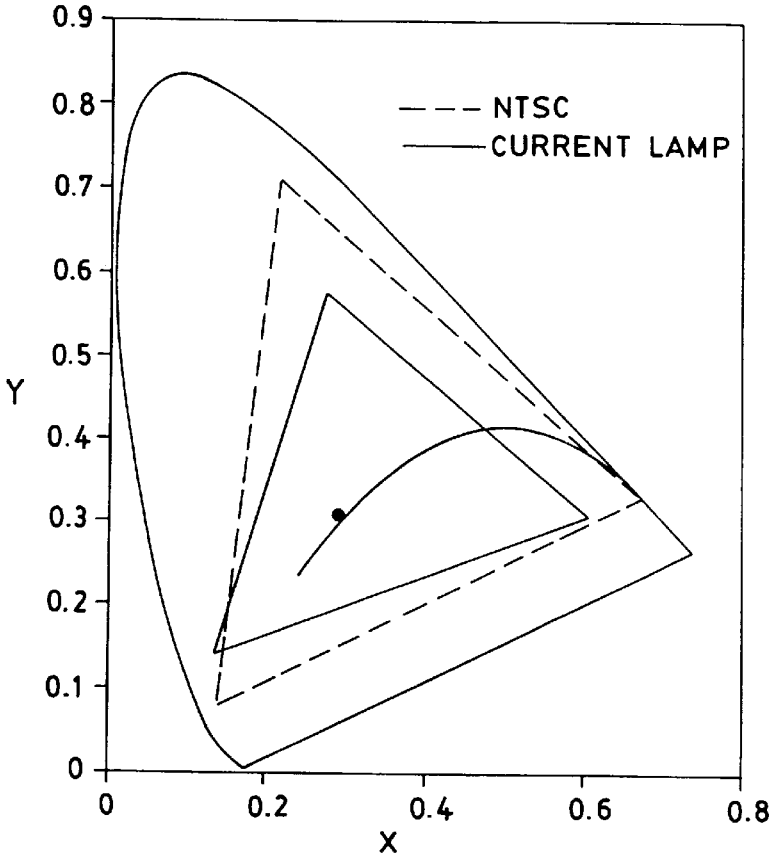
FIG. 6 shows a graphical view of the color coordinates of RGB components of a typical electrodeless projection lamp in accordance with the invention.

Referring to FIG. 6, a fan-shaped cooling jet on an EHID lamp has produced the color coordinates, as shown. The spectral power distribution has been passed through suitable RGB filters. Such filters are interference filters defining the R (red) band between approximately 610–720 nm, the G (green) band between approximately 500–580 nm, and the B (blue) band between approximately 410–500 nm. The bands can be defined only approximately because the cutoff wavelength of typical interference filters is not infinitely sharp, but rolls off with wavelength. The chromaticity points are shown in relation to the NTSC standard for television. The instant invention with appropriate volatizable fill chemistry can closely match the phosphor emission from a CRT, which is the basis of the NTSC specification.

The color coordinate of the unfiltered lamp is next to the black body curve. As described above, the highest luminance zone is in the center of the capsule or envelope, and is less prone to wander over life.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An electrodeless high intensity discharge lamp (EHID) having means for producing an electric discharge within its light transmissive envelope, said light transmissive envelope having a constriction formed about a mid-portion thereof, said constriction increasing power density to said electric discharge sustained within the envelope, said envelope being filled with a volatizable fill that is capable of being energized into a light emitting state.

2. The EHID lamp in accordance with claim 1, wherein the fill consists of aluminum triiodide, indium iodide, and thorium tetraiodide with mercury and an inert gas selected from a group of inert gases consisting of argon, krypton, xenon, and mixtures thereof.

3. The EHID lamp in accordance with claim 1, wherein said EHID lamp is overpowered to increase the luminance of the electric discharge, said EHID lamp further comprising means for cooling said light transmissive envelope including a number of jets of air to maintain a surface temperature in an approximate range of between 800 to 1,000° C.

4. The EHID lamp in accordance with claim 3, wherein said means for cooling comprises means for directing said jets of air at an upper surface of a horizontally burning lamp with an airflow of approximately between 2 to 20 l/min.

5. The EHID lamp in accordance with claim 3, wherein the jets of air provide an airflow of approximately 10 l/min.

6. The EHID lamp in accordance with claim 3, wherein said EHID has a power density of about 9000 W/cm$^3$.

7. The EHID lamp in accordance with claim 3, wherein said means for cooling comprises three radial jets of air spaced approximately equally apart, and disposed about an envelope axis, for cooling said envelope in a uniform manner.

8. The EHID lamp in accordance with claim 1, further comprising means for cooling said envelope, including three radial jets of air spaced approximately equally apart and disposed about an envelope axis, for cooling said envelope in a uniform manner.

9. The EHID lamp in accordance with claim 8, wherein airflow through the jets is approximately 10 l/min.

10. The EHID lamp in accordance with claim 9, wherein said cooling means includes nozzles that have an oval cross section that produces a fan of air which uniformly cools the envelope and which is oriented with respect to said envelope to provide an airflow direction thereto that is parallel to a long axis of said envelope.

11. The EHID lamp in accordance with claim 1, wherein the fill consists of aluminum triiodide, indium iodide, and hafnium tetraiodide with mercury, and an inert gas selected from a group of inert gases consisting of argon, krypton, xenon, and mixtures thereof.

12. The EHID lamp in accordance with claim 1, wherein the fill consists of aluminum triiodide, indium iodide, and zirconium tetraiodide with mercury and an inert gas selected from a group of inert gases consisting of argon, krypton, xenon, and mixtures thereof.

13. An electrodeless high intensity discharge lamp (EHID) of unconstricted cross section which is overpowered to achieve high luminance, said electrodeless lamp having a light transmissive envelope and means for cooling said light transmissive envelope with directed airflow that parallels a longitudinal axis of said envelope, said electrodeless lamp further comprising means for powering said envelope with a power density of about 9000 W/cm$^3$.

14. An electrodeless high intensity discharge lamp (EHID) having means for producing an electric discharge within its light transmissive envelope, said light transmissive envelope having a thickened wall portion about a mid-portion thereof, said thickened wall portion increasing power density to said electric discharge sustained within the envelope, said envelope being filled with a volatizable fill that is capable of being energized into a light emitting state.

15. The EHID lamp in accordance with claim 14, wherein the fill consists of aluminum triiodide, indium iodide, and thorium tetraiodide with mercury and an inert gas selected from a group of inert gases consisting of argon, krypton, xenon, and mixtures thereof.

16. The EHID lamp in accordance with claim 14, wherein said EHID lamp is overpowered to increase the luminance of the electric discharge, said EHID lamp further comprising means for cooling said light transmissive envelope including a number of jets of air to maintain a surface temperature in an approximate range of between 800 to 1,000° C.

17. The EHID lamp in accordance with claim 16, wherein said means for cooling comprises means for directing said jets of air at an upper surface of a horizontally burning lamp with an airflow of approximately between 2 to 20 l/min.

18. The EHID lamp in accordance with claim 16, wherein the jets of air provide an airflow of approximately 10 l/min.

19. The electrodeless high intensity discharge lamp (EHID) in accordance with claim 16, wherein said EHID has a power density of about 9000 W/cm$^3$.

20. The EHID lamp in accordance with claim 16, wherein said means for cooling comprises means for providing three radial jets of air spaced approximately equally apart and disposed about an envelope axis, for cooling said envelope in a uniform manner.

21. The EHID lamp in accordance with claim 14, further comprising means for cooling said envelope, including three radial jets of air spaced approximately equally apart and disposed about an envelope axis, for cooling said envelope in a uniform manner.

22. The EHID lamp in accordance with claim 21, wherein airflow through the jets is approximately 10 l/min.

23. The EHID lamp in accordance with claim 22, wherein said cooling means includes nozzles that have an oval cross section that produces a fan of air, which uniformly cools the envelope and which is oriented with respect to said envelope to provide an airflow direction thereto that is parallel to a long axis of said envelope.

24. The EHID lamp in accordance with claim 14, wherein the fill consists of aluminum triiodide, indium iodide, and hafnium tetraiodide with mercury and an inert gas selected from a group of inert gases consisting of argon, krypton, xenon, and mixtures thereof.

25. The EHID lamp in accordance with claim 14, wherein the fill consists of aluminum triiodide, indium iodide, and zirconium tetraiodide with mercury and an inert gas selected from a group of inert gases consisting of argon, krypton, xenon, and mixtures thereof.

* * * * *